US006545644B1

(12) United States Patent
Sinclair et al.

(10) Patent No.: US 6,545,644 B1
(45) **Date of Patent: *Apr. 8, 2003**

(54) WIDEBAND SLOT ANTENNA WITH LOW VSWR

(75) Inventors: Gordon G. Sinclair, Mountain View, CA (US); Po-Shin Cheng, Fremont, CA (US)

(73) Assignee: SPX Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/915,747

(22) Filed: Jul. 26, 2001

Related U.S. Application Data

(63) Continuation of application No. 09/643,560, filed on Aug. 21, 2000, now Pat. No. 6,285,334.

(51) Int. Cl.[7] ..... H01Q 13/00

(52) U.S. Cl. ..... 343/767; 343/770; 343/771

(58) Field of Search ..... 343/767, 770, 343/771, 772, 768; H01Q 13/00

(56) References Cited

U.S. PATENT DOCUMENTS

| | | | | |
|---|---|---|---|---|
| 2,658,145 A | | 11/1953 | Dorne et al. | 343/767 |
| 3,858,221 A | | 12/1974 | Harrison et al. | 343/815 |
| 3,990,079 A | | 11/1976 | Epis | 343/771 |
| 6,150,988 A | * | 11/2000 | Sinclair et al. | 343/767 |
| 6,285,334 B1 | * | 9/2001 | Sinclair et al. | 343/767 |

OTHER PUBLICATIONS

Jasik, Henry, "Antenna Engineering Handbook", 1st Edition, McGraw–Hill, 1961, pp. 186–189.

"Antenna Engineering Handbook", McGraw–Hill, 1947, Ch. 7, pp. 188–189.

Newman, E.H. and Thiele, Garry A., "Some Important Parameters in the Design of T–Bar Fed Slot Antennas", IEEE Transactions on Antennas and Propagation, Jan. 1975, pp. 97–100.

Klein, Carl F., "An Equivalent Circuit for the Tee–Fed Slot Antenna", IEEE Transactions on Antennas and Propagation, Mar. 1970, pp. 280–282.

Sams, Howard "Data for Radio Engineers", 5th Edition, 1968.

* cited by examiner

*Primary Examiner*—Hoanganh Le
(74) *Attorney, Agent, or Firm*—Baker & Hostetler LLP

(57) ABSTRACT

A slot antenna is described. The slot antenna includes a waveguide having a first side, a second side, a third side, and a fourth side, a closed end and an open end. The second side extends substantially perpendicularly from a first end of the first side. The third side extends substantially perpendicularly from a second end of the first side. The fourth side extends between the second side and the third side with the fourth side substantially parallel to the first side. The sides and the closed end form a cavity. A feeding point is located substantially midway between the first end of the first side and the second end of the first side. A T-Bar is located inside the cavity, the T-bar having a center member extending from the feeding point into the cavity and a cross member having a length extending across the cavity between the second side and the third side. The cross member is shaped as a stepped cylinder having a first diameter in a central portion along the length of the cross member and having a second diameter in an outer portion along the length of the cross member.

10 Claims, 9 Drawing Sheets

WIDEBAND SLOT ANTENNA WITH LOW VSWR

This is a continuation of application Ser. No. 09/643,560, filed Aug. 21, 2000, now U.S. Pat. No. 6,285,334.

FIELD OF THE INVENTION

The present invention relates generally to antennas. More specifically, a wideband slot antenna with a low VSWR is disclosed.

BACKGROUND OF THE INVENTION

With the advent of digital television, a need has arisen for broadband multi-channel antennas suitable for radiating signals at UHF wavelengths. In some jurisdictions, various regulations require stations to begin broadcasting digital signals and also to continue broadcasting analog signals. Stations may be assigned frequency bands that are close together or far apart for such multiple broadcasts. As a result, it would be extremely useful if a broadband antenna could be developed that would radiate efficiently from 470 MHz to 860 MHz, the UHF television band, and would also have a low VSWR at its input terminal in that band. Typically, a VSWR of about 01.15 or less is required in a television transmission system.

Dipole arrays may be designed that are capable of broadband operation across the UHF band and that meet the VSWR requirements for television transmission systems. However, there are disadvantages to using dipole arrays. A dipole array assembled in a large panel on a tower has a large wind load and tends to be less robust mechanically than other antenna designs. Dipole arrays also tend to be mounted on large structures to accommodate the mechanical loads of the panels. This makes it hard to achieve desirable radiation patterns for the antenna system.

Slot antennas have been used in physically demanding environments such as on airframes for narrow bandwidth applications with success. Slot antennas, however, have not been developed that can operate across the UHF band with the low input VSWR required for a television transmission system. A waveguide slot antenna consists of a length of waveguide short circuited at one end and open circuited at the other. The open end is usually terminated in some type of ground screen, and the antenna is excited by a coaxial to waveguide transition.

FIG. 1 is a diagram illustrating a slot antenna with a crossbar transition between the coaxial cable to the waveguide. A slot antenna 100 is shown. A waveguide 102 is closed on one end and open at open end 103. Slot antenna 100 is fed by a 50-ohm coaxial cable line 104 that is connected to the top of waveguide 102. The outside of the coaxial line is electrically connected to the waveguide. The center conductor of the line is electrically connected a T-shaped bar 106 that extends downward into the waveguide cavity. T-shaped bar 106 includes a cross member 108 that extends the length of the cavity and is terminated at the sides 110 of the cavity. Such an antenna is generally referred to as a T-bar fed slot antenna.

Such antennas have been the object of considerable study in the prior art. A cavity backed rectangular slot antenna is described in Reference 1, "Antenna Engineering Handbook", Henry Jasik, First Edition, McGraw-Hill, 1961, which is herein incorporated by reference for all purposes. The original design work was published in Very High Frequency Techniques, compiled by the Radio Research Laboratory and published by McGraw-Hill in 1947. The VSWR of two T-bar fed slot antennas investigated is shown in FIG. 2A. The VSWR results for the earlier investigation of such T-bar slot antennas is shown in FIG. 2B.

Another investigation of the design of T-bar fed slot antennas is provided in Reference 2, "Some Important Parameters in the Design of T-Bar Fed Slot Antennas, by E. H. Newman and Garry A. Thiele, IEEE Transactions on Antennas and Propagation, January 1975, pages 97–100, which is herein incorporated by reference for all purposes. The VSWR of a tuned T-bar fed slot antenna is shown in FIG. 2C. Newman, et al., further describes how to design T-bar fed slot antennas for various bandwidths.

Although the performance of such antennas described in the prior art is good, the VSWR across a broad bandwidth of 1.8 $\lambda$ corresponding to the UHF frequency spectrum is too large. The VSWR is greater than 1.5 at several points and in particular, tends to increase substantially at high frequencies within its operating band. The VSWR of the antennas described in FIGS. 2A and 2B increases to above 2 at the high frequency end and even the tuned antenna shown in FIG. 2C has a peak VSWR of greater than 2 at the high frequency end of its operating band.

In spite of the considerable work that has been done on T-bar fed slot antennas, the performance of such antennas has not been improved to the point where such antennas may be used with success across the entire UHF frequency spectrum for television transmission. Other techniques are needed to enable the use of slot antennas for such applications. It would be useful if a slot antenna could be developed that could meet the design requirements for television transmission across the UHF band.

SUMMARY OF THE INVENTION

A broadband low VSWR slot antenna is disclosed that can be used for the transmission of television signals in the UHF band. The slot antenna is fed using a modified T-bar that has a smaller diameter at the ends of the T-bar which are attached at the ends of the slot or cavity than at the center of the T-bar. The opening of the cavity is attached to a ground plane and one or more probes is added to the ground plane at a location opposite the feeding point where the cavity is fed. The slot antenna may be further modified by extending the sides of the cavity where the ends of the T-bar reach the sides of the cavity. In a addition, a ridge may be added to the cavity. A dielectric radome may be included in front of the cavity and a pair of covers may be added to the sides of the cavity to compensate for the radome.

An array of slot antennas is also disclosed. The array includes slot antennas stacked on top of each other and spaced circumferentially in a cylindrical array with their T-bars vertically oriented.

It should be appreciated that the present invention can be implemented in numerous ways, including as a process, an apparatus, a system, a device, a method, or a computer readable medium such as a computer readable storage medium or a computer network wherein program instructions are sent over optical or electronic communication lines. Several inventive embodiments of the present invention are described below.

In one embodiment, a slot antenna is disclosed. The slot antenna includes a waveguide having a first side, a second side, a third side, and a fourth side, a closed end and an open end. The second side extends substantially perpendicularly from a first end of the first side. The third side extends substantially perpendicularly from a second end of the first side. The fourth side extends between the second side and the third side with the fourth side substantially parallel to the first side. The sides and the closed end form a cavity. A feeding point is located substantially midway between the first end of the first side and the second end of the first side. A T-Bar is located inside the cavity, the T-bar having a center member extending from the feeding point into the cavity and a cross member having a length extending across the cavity between the second side and the third side. The cross member is shaped as a stepped cylinder having a first diameter in a central portion along the length of the cross member and having a second diameter in an outer portion along the length of the cross member.

In another embodiment a slot antenna is disclosed. The slot antenna includes a waveguide having a first side, a second side, a third, side, and a fourth side, a closed end and an open end. The second side extends substantially perpendicularly from a first end of the first side. The third side extends substantially perpendicularly from a second end of the first side and the fourth side extends between the second side and the third side. The fourth side is substantially parallel to the first side with the sides and the closed end forming a cavity. A feeding point is located substantially midway between the first end of the first side and the second end of the first side. A T-Bar is located inside the cavity. The T-bar has a center member extending from the feeding point into the cavity and a cross member having a length extending across the cavity between the second side and the third side. A ground screen is attached to the open end of the waveguide and extending substantially perpendicularly away from the four sides of the waveguide. A conductive probe extends substantially perpendicularly from the ground screen in a direction away from the cavity.

In another embodiment, a slot antenna array is disclosed. The slot antenna array includes a plurality of slot antennas, Each slot antenna includes a waveguide having a first side, a second side, a third, side, and a fourth side, a closed end and an open end. The second side extends substantially perpendicularly from a first end of the first side. The third side extends substantially perpendicularly from a second end of the first side and the fourth side extends between the second side and the third side. The fourth side is substantially parallel to the first side, the sides and the closed end forming a cavity. A feeding point is located substantially midway between the first end of the first side and the second end of the first side. A T-Bar is located inside the cavity, the T-bar having a center member extending from the feeding point into the cavity and a cross member having a length extending across the cavity between the second side and the third side. The cross member is shaped as a stepped cylinder having a first diameter in a central portion along the length of the cross member and having a second diameter in an outer portion along the length of the cross member. The plurality of slot antennas are arrayed about the circumference of a circle in a circular array with the open ends of the slot antennas facing radially outward.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION

Figure 1:
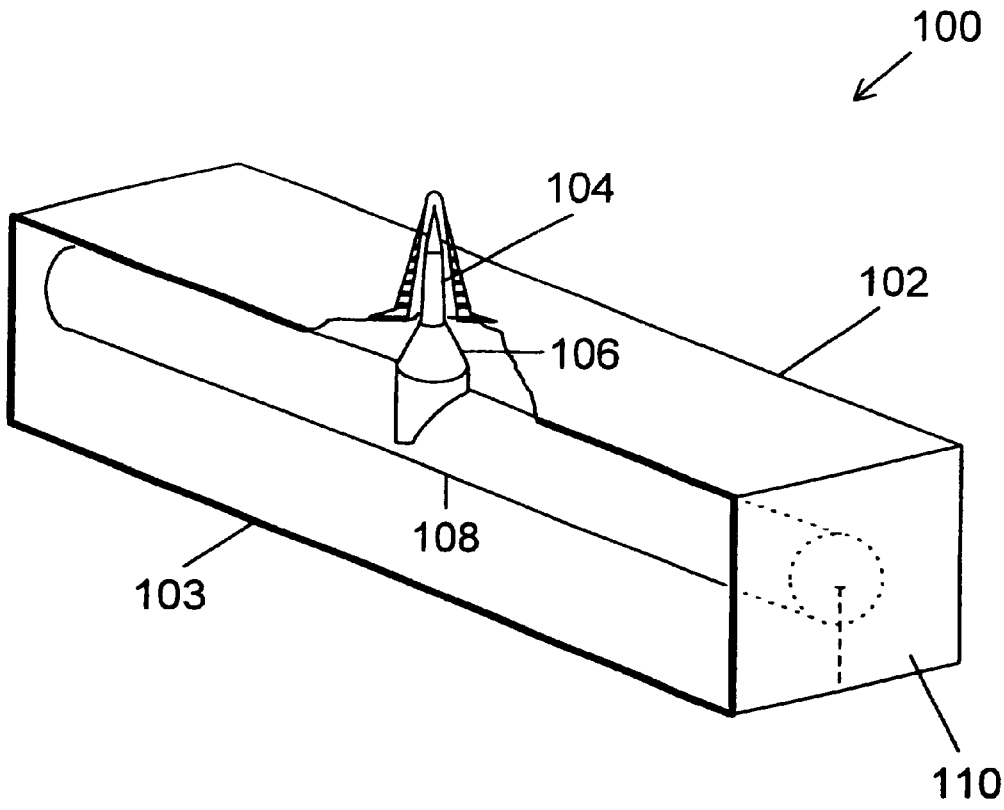
PRIOR ART Figure 1
FIG. 1 is a diagram illustrating a slot antenna with a crossbar transition between the coaxial cable to the waveguide.
Figure 2A:
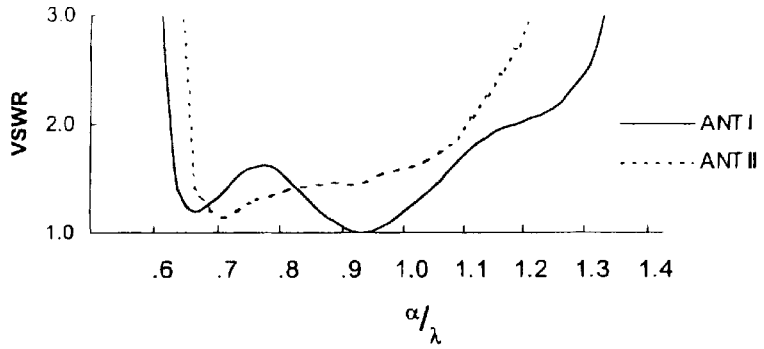
Figure 2A PRIOR ART
FIG. 2A is a graph illustrating the VSWR of two T-bar fed slot antennas.
Figure 2B:
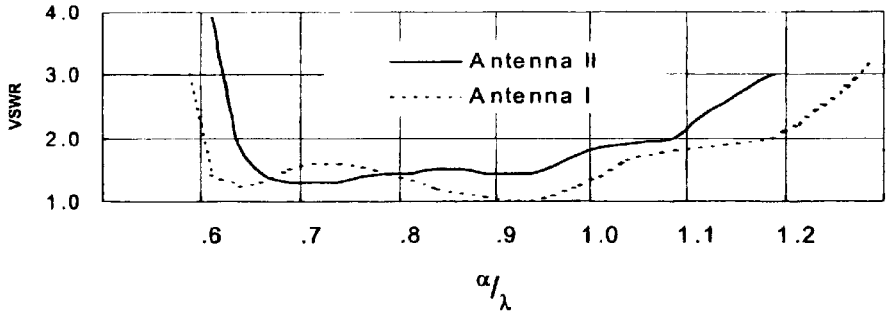
Figure 2B PRIOR ART
FIG. 2B is a graph illustrating VSWR of two T-bar fed slot antennas.
Figure 2C:
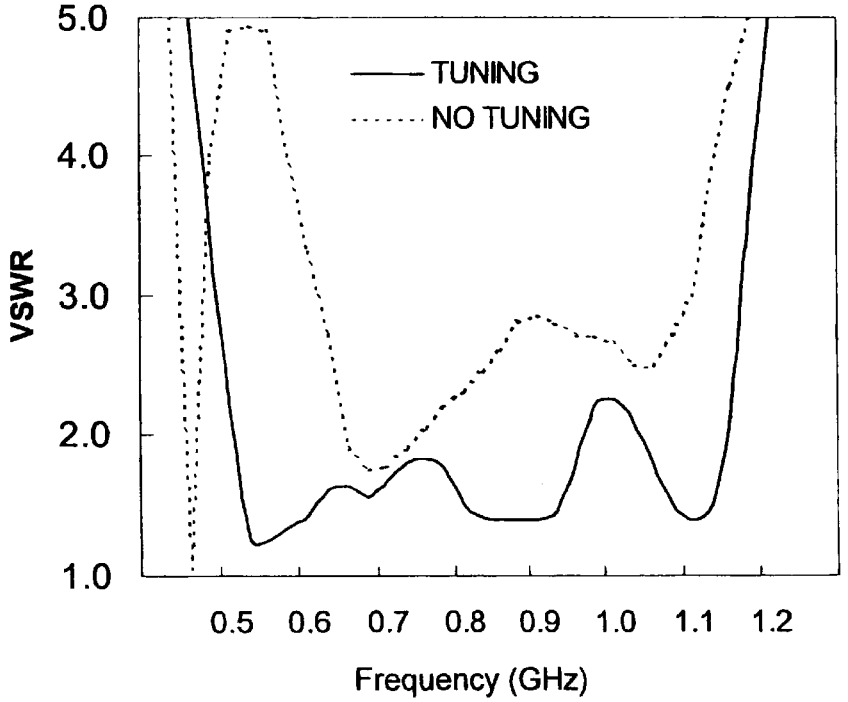
Figure 2C PRIOR ART
FIG. 2C is a graph illustrating VSWR of a tuned T-bar fed slot antenna.

A detailed description of a preferred embodiment of the invention is provided below. While the invention is described in conjunction with that preferred embodiment, it should be understood that the invention is not limited to any one embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, details relating to technical material that is known in the technical fields related to the invention has not been described in detail in order not to unnecessarily obscure the present invention in such detail.

A modified T-bar fed slot antenna is used to meet the VSWR and bandwidth requirements for television transmission across the UHF band. As is described below, a number of modifications are used to achieve the desired performance. Such modifications include stepping the diameter of the cross member of the T-Bar, adding one or more probes to a ground screen connected to the open end of the slot antenna, adding a ridge inside the cavity of the slot antenna near the feed point of the antenna, and covering the ends of the slot when a dielectric radome is used. In addition, a plurality of slot antennas may be arrayed in a circular or a cylindrical array. Cross coupling between the arrayed antennas tends to further lower the VSWR. In a cylindrical array, antennas stacked vertically above each other are fed by transmission signals that are in phase.

It should be noted that in the following discussion, the design of antenna for the UHF band between 470 MHz and 860 MHz is described. As is described in Jasik and Neumen et. al., which were previously incorporated by reference, the size of a slot antenna may be scaled to work at different bandwidths. Therefore, the modifications disclosed herein to UHF slot antenna may be applied to other slot antennas if scaled appropriately. Where appropriate, dimensions or sizes will be described in this specification both in terms of a size used for the UHF antenna of the preferred embodiment as well as in terms of the a minimum wavelength, center wavelength, or a maximum wavelength, referring to the band in which the antenna is intended to operate. In addition, it should also be noted that each of the techniques disclosed herein may be used separately or together with certain of the other techniques in different embodiments.

The T-bar slot feed system excites two modes in the waveguide cavity. One of the modes is the principal radiating mode. It produces an electric field perpendicular to the direction of radiation away from the cavity. The principal mode is referred to as the $TE_{0,1}$ mode. The other mode, the $TM_{1,1}$ mode, operates at a frequency below waveguide cut-off and does not radiate a significant amount of energy. The stored energy in the second mode causes the slot to have a higher-than desirable VSWR. Additionally, the T-bar slot feed can be shown to have a non-radiating transmission line mode that contributes significantly to the reactance at the input of the slot. By suitable modification of the T-Bar structure and how it is terminated at the cavity walls, the reactance at the input of the slot can be significantly reduced, particularly at the low frequency end of the band of interest.

The T-bar can be viewed as a section of transmission line in a trough cavity which has a well-known characteristic impedance. Using a line which has a uniform impedance of about 80 Ohms results in a high reactance at the input to the slot at the low frequencies, where the line is about 112 electrical degrees long. At the higher frequency end of the band, the T-bar is approximately 180 electrical degrees long and always presents a low reactance at the input to the slot, regardless of its characteristic impedance. By varying the characteristic impedance of the T-bar along it's length with a higher impedance near the short-circuit end, the line presents a lower reactance at the low frequency end of the band. This enables an optimal input reactance at both ends of the frequency band of interest.

Figure 3A:
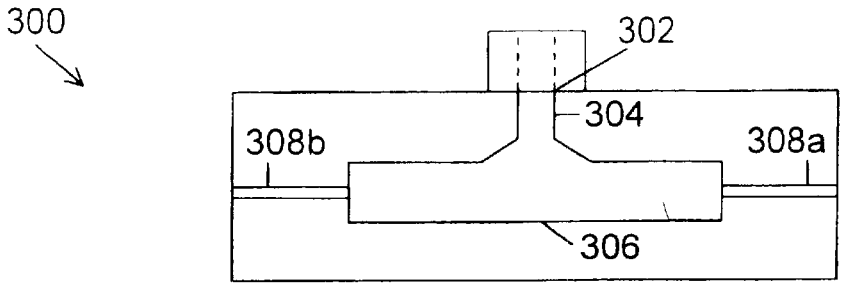
FIG. 3A is a diagram illustrating a T-bar fed slot antenna fed by a T-bar having a stepped diameter.

In one embodiment, the characteristics impedance of the T-bar is varied by changing the diameter of the T-bar along its length. FIG. 3A is a diagram illustrating a T-bar fed slot antenna 300 fed by a T-bar having a stepped diameter. The slot antenna is fed at a feeding point 302. The T-bar includes a center member 304 extending downward from feeding point 302. The cross member of the T-bar includes a center portion 306 having a large diameter and two outer portions 308A and 308B having a smaller diameter.

In addition to stepping the impedance of the T-bar, the termination of the T-bar at the ends where it meets the cavity walls can be modified to compensate the input impedance further. Use of an open-circuit, quarter-wave (at the median frequency) transmission line produces compensating reactances, which further improve the input reactance of the slot at the band edges. In one embodiment, the transmission line is provided by a cavity extension where the ends of the T-bar meet the cavity walls. The length and impedance of the cavity extension may be adjusted in different embodiments to provide a desired reactance.

Figure 3B:
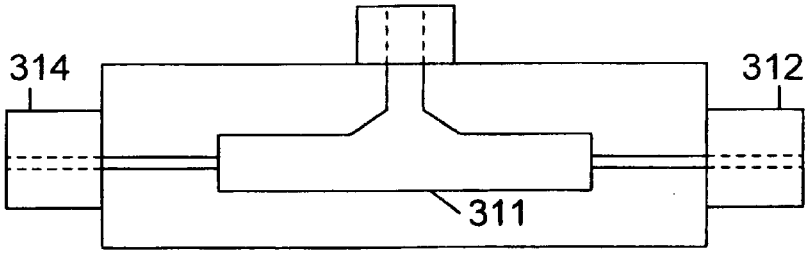
FIG. 3B is a diagram illustrating a T-bar fed slot antenna with cavity extensions for terminating the ends of the T-bar.

FIG. 3B is a diagram illustrating a T-bar fed slot antenna with cavity extensions for terminating the ends of the T-bar. A T-bar 311 has outer ends which extend beyond the cavity into a cavity extension 312 and a cavity extension 314. The characteristic impedance of the transmission line extending beyond the cavity and the length of the transmission line is controlled to lower the VSWR of the slot antenna.

The T-bar characteristic impedance and termination partially compensate the overall slot impedance such that the VSWR can be lowered to about 1.3:1 across the entire UHF band. The stepped-impedance and open-circuit termination techniques thus improve the performance of the slot antenna, but not to within the requirements set forth above for television transmission.

In order to further reduce the VSWR to the very low levels,required for television transmission, one or more probes is added to a ground screen attached to the front of the open end of the slot antenna near the slot aperture on the side of the slot that is opposite the side on which the slot is fed. The non-radiating $TM_{1,1}$ mode can significantly effect the impedance of the slot since the band of operation is still close to the cut-off frequency of that mode. The use of probes near the slot aperture lowers the variation of the slot impedance within the band of use and to produce an overall VSWR of 1.15:1 or less across the whole UHF band. The radiation from the probes is very small and produces a signal of orthogonal polarization to that of the principle radiation, thus the effect of these probes is to reduce the overall VSWR of the slot without significantly effecting the efficiency of the slot in it's principle radiating mode.

Figure 3C:
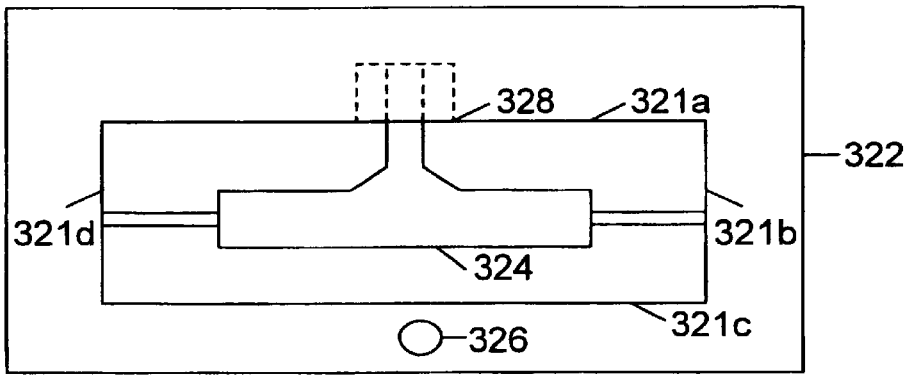
FIG. 3C is a diagram illustrating a T-bar fed slot antenna with a ground screen extending perpendicularly from the sides of the cavity.

FIG. 3C is a diagram illustrating a T-bar fed slot antenna with a ground screen extending perpendicularly from the sides of the cavity. The cavity is bounded by four sides, 321*a,* 321*b,* 321*c* and 321*d.* One end ofthe cavity is closed, and the other end is open. The open end is attached to a ground screen 322 which extends from each of the four sides in a substantially perpendicular direction. A T-bar 324 is inside the cavity. A probe 326 extends perpendicularly from ground screen 322 on the side of the ground screen that is opposite a feeding point 328 where a coaxial cable may be attached. Probe 326 further reduces the VSWR of the slot antenna.

Figure 3D:
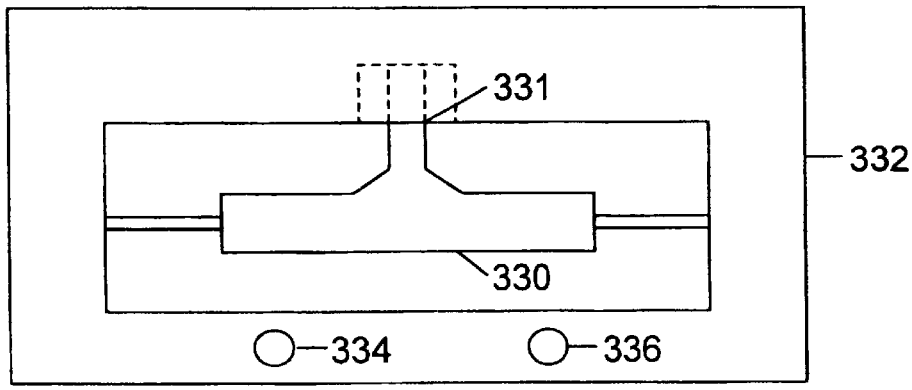
FIG. 3D is a diagram illustrating a slot antenna having two probes extending from a ground screen.

FIG. 3D is a diagram illustrating a slot antenna having two probes extending from a ground screen. The slot antenna is fed by a T-bar 330 that extends inside the slot cavity from a feeding point 331. A ground screen 332 extends outward from the sides of the cavity at the open end of the cavity. A pair of probes, 334 and 336 extend perpendicularly from the ground screen in the direction away from the cavity. Probes 334 and 336 are symmetrically spaced about the center of the cavity on the ground screen on the side opposite feeding point 331.

Figure 3E:
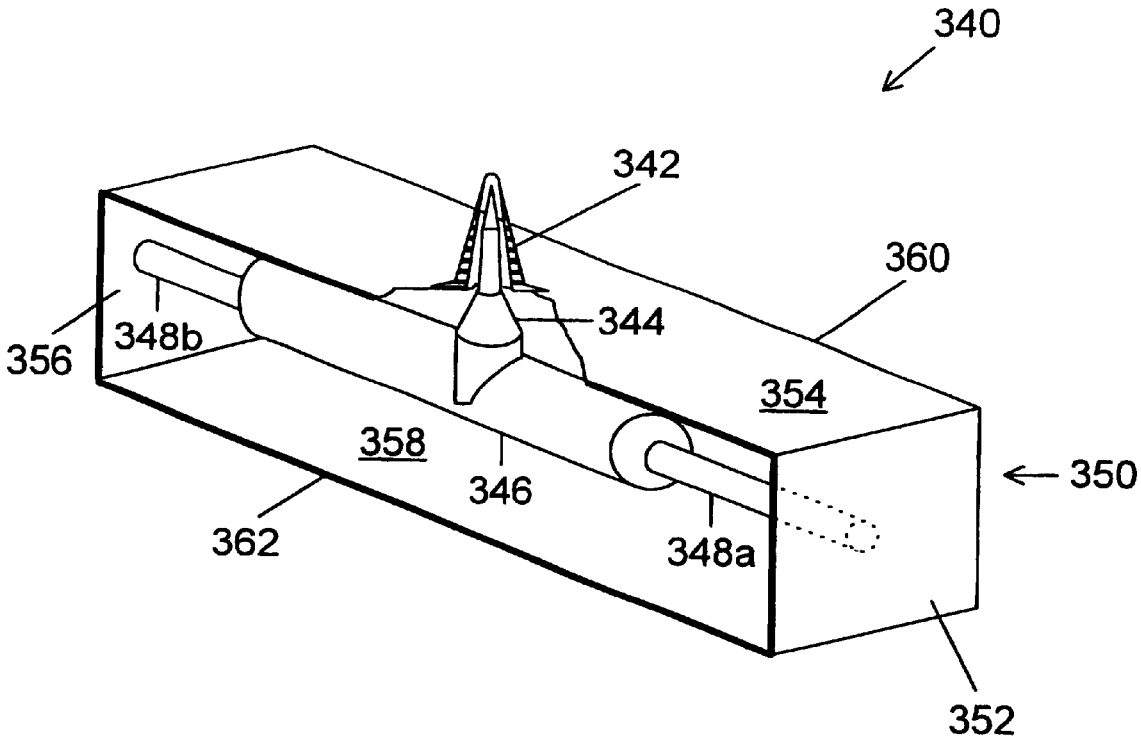
FIG. 3E is a three dimensional diagram illustrating a T-bar fed slot antenna fed by a T-bar having a stepped diameter.

FIG. 3E is a three dimensional diagram illustrating a T-bar fed slot antenna 340 fed by a T-bar having a stepped diameter. The slot antenna is fed at a feeding point 342. The T-bar includes a center member 344 extending downward from feeding point 342. The cross member of the T-bar includes a center portion 346 having a large diameter and two outer portions 348*a* and 348*b* having a smaller diameter. The antenna 340 comprises a wave guide 350 having a right side 352, a top side 354, a left side 356, a bottom side 358, a closed back end 360, and an open front end 362.

Figure 4:
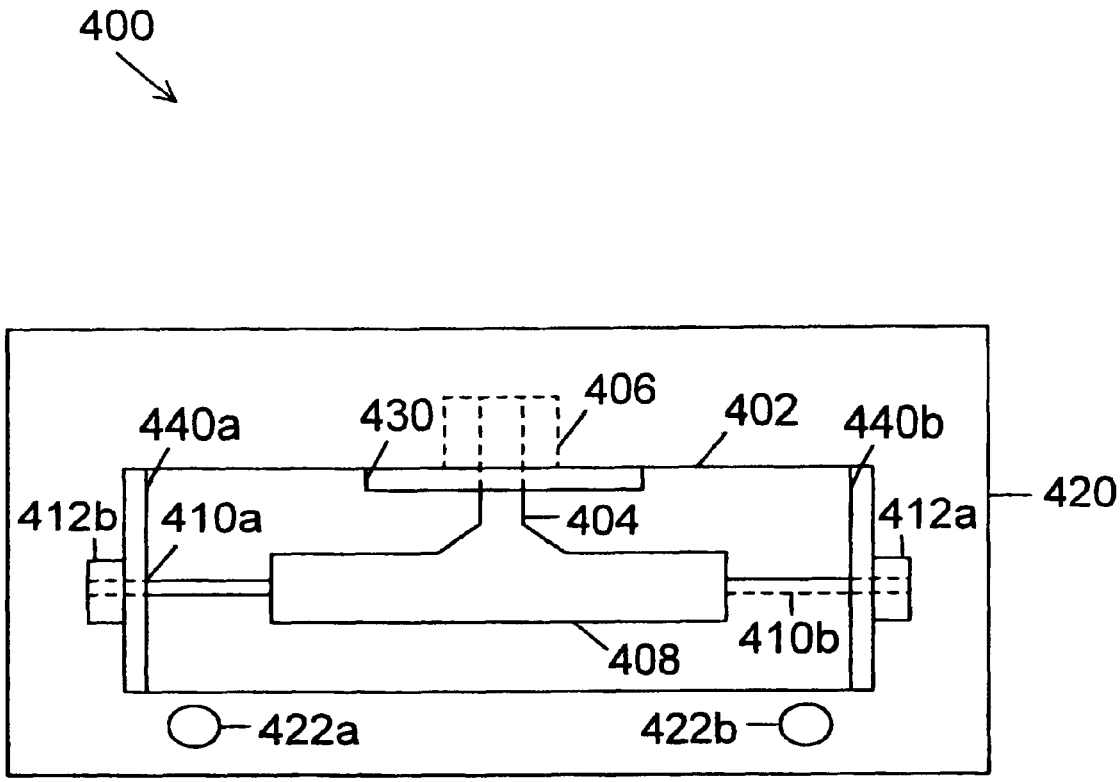
FIG. 4 is a diagram illustrating a preferred T-bar fed slot antenna 400 designed using the above described techniques for the UHF band.

FIG. 4 is a diagram illustrating a preferred T-bar fed slot antenna 400 designed using the above described techniques for the UHF band. A slot 402 is 0.62 $\lambda$ long where $\lambda$ is the wavelength at the lowest operating frequency (470 MHz), 0.2 λ wide and 0.21 λ deep. A center member 404 of the T-bar extends into the cavity at a feeding point 406 and the cross member of the T-bar includes a center portion 408 made of a larger 0.065 λ (1.625 inch) diameter tube of characteristic impedance 80 Ohms. Outer portions 410*a* and 410*b* of the center member of the T-bar are two 0.01 λ (0.25 inch) lengths of transmission line of 200 Ohm impedance that are connected at the two ends of the slot. The termination of the T-bar lines utilizes an open-circuit 0.25 λ section of coaxial line of 66 Ohm characteristic impedance.

Since they are non-radiating terminations, the terminating lines are extended beyond the wall of the cavity in cavity extensions 412*a* and 412*b*. In some embodiments, the terminating lines may be omitted and the T-bar connected directly to the sides of the slot if the slot is used in an array where it is not feasible to include the cavity extensions because of space constraints. In such cases, the stepped diameters of the T-bar may be adjusted so that the performance may be nearly as good as with the extensions. A ground plane 420 is included around the open end of the slot. On the surface of the ground-plane, two short probes 422*a* and 422*b* that are about 0.125 λ high are placed symmetrically about the centerline of the slot on the side of the ground plane opposite the feeding point, 0.155 λ on either side.

A ridge 430 is included inside the cavity at the edge of the open end on the side where the feeding point is located. The ridge is 0.5 inch high by 0.5 inch wide by 7.8 inch long. If a dielectric radome (not shown) is used to cover the opening, then two conductive covers 440*a* and 440*b* are used over the ends of the slot as shown in FIG. 4. In one embodiment, a polyethylene cover is placed about one third of an inch over the opening and two conductive covers extend 0.5 inch over the slot on each end of the slot.

It should be noted that the preferred T-bar fed slot antenna described in FIG. 4 combines a variety of the techniques taught herein and that such techniques may be used individually as well in accordance with the spirit and scope of this invention.

Figure 5:
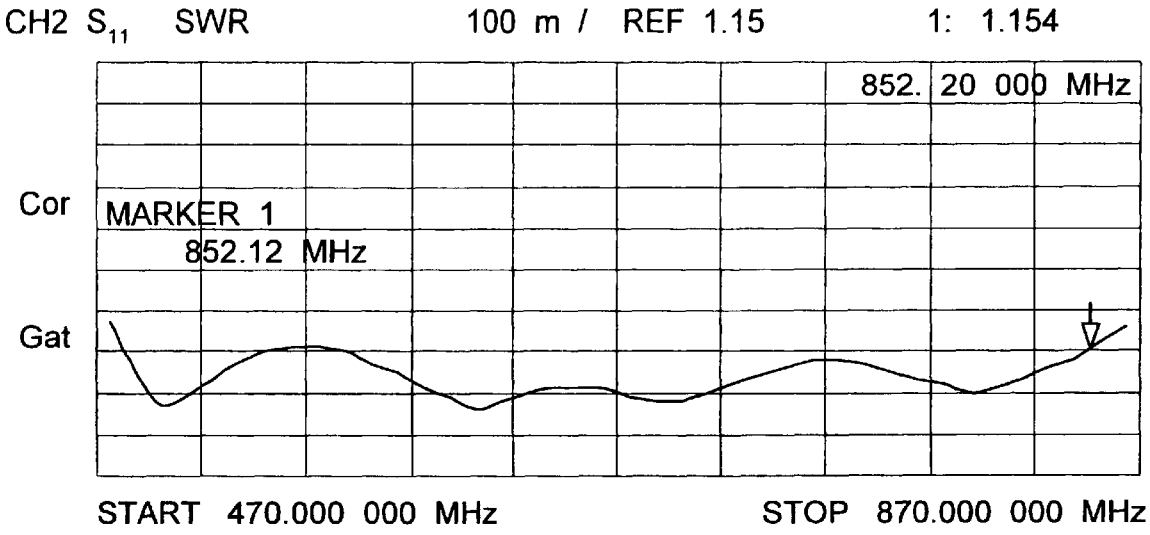
FIG. 5 is a graph illustrating the VSWR of the slot antenna shown in FIG. 4.

FIG. 5 is a graph illustrating the VSWR of the slot antenna shown in FIG. 4. The VSWR is below 1.10 over most of the UHF frequency band and extends above 1.10 but below 1.15 only at the very low end of the band. Thus, the techniques described above function to significantly lower the VSWR of the slot antenna, enabling the slot antenna to be used for broadband television transmission in the UHF band.

So far, a single cavity slot antenna with a T-bar feed has been described. Using the described techniques, the VSWR of such an antenna has been lowered to less than 1.15 across the entire UHF spectrum. Arrays of such antenna are generally used to achieve suitable radiation patterns and coverage areas. Typical systems use four or eight elements arrayed around a circle and stacked four, eight, sixteen or thirty-two elements high to create high gain arrays. The impedance of a T-bar slot antenna in an array is substantially the same as the impedance of such an antenna by itself. The VSWR of slot antennas in an array is slightly improved by mutual coupling between elements, particularly at the lower end of the band of interest. Referring back to FIG. 5, it is only at the lower end of the spectrum that the VSWR is above 1.10 and almost reaches 1.15. In an array, the VSWR is less than 1.10 across the entire band. Thus, using the techniques described herein, it is possible to provide an array of slot antennas that operates across the entire UHF band with a very low VSWR that meets the requirements for television transmission. This achieves a very low VSWR for the array over the whole television transmission band.

Figure 6A:
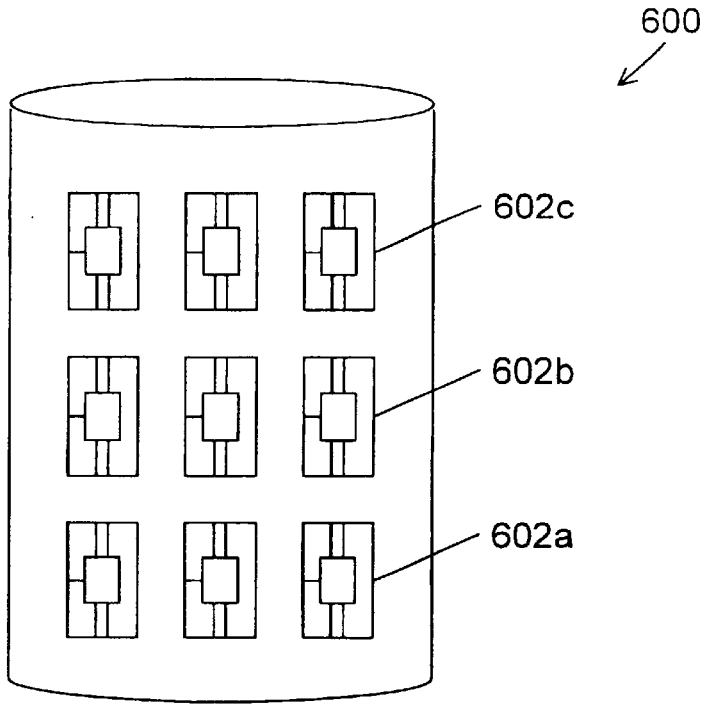
FIG. 6A is a diagram illustrating a cylindrical array of slot antennas.

FIG. 6A is a diagram illustrating a cylindrical array 600 of slot antennas. The array includes stacks of slot antennas such as the stack of slot antennas comprised of a slot antenna 602A, 602B and 602C. The antennas are stacked vertically and arranged in a circular array so that the ground plane extending from each of the openings of the slot antenna forms a cylinder with the cavities of the slot antenna forming holes in the cylinder.

Figure 6B:
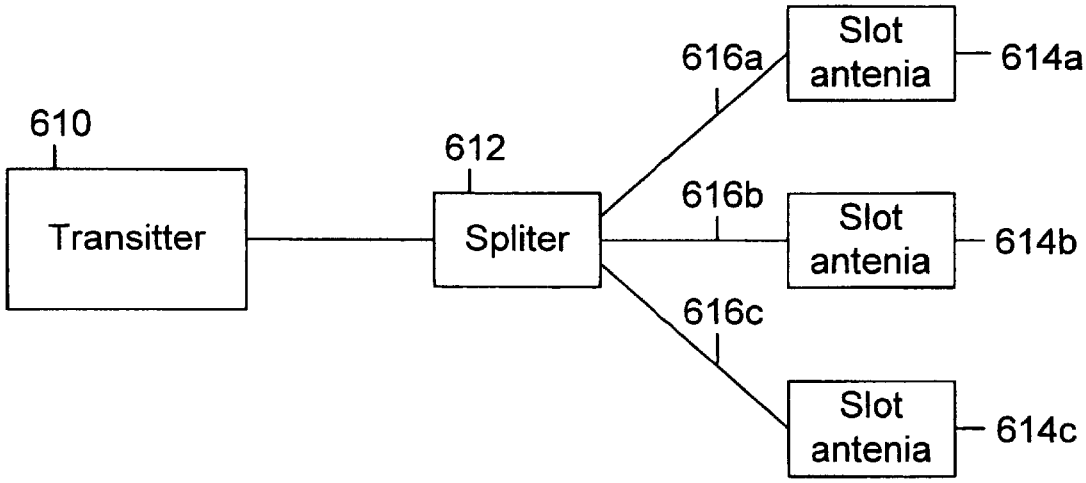
FIG. 6B is a block diagram illustrating a feeding arrangement used to feed the antennas in one of the stacks included in array 600.

FIG. 6B is a block diagram illustrating a feeding arrangement used to feed the antennas in one of the stacks included in array 600. A transmitter 610 sends a signal to a splitter 612. Splitter 612 splits the signal into three signals. The three signals are fed to slot antennas 614A, 614B, and 614C from splitter 612 using three lines, 616A, 616B and 616C which are all of the same length. Thus, the slot antennas in the stack are all fed in phase. It has been found that feeding the slot antennas in phase improves the VSWR of the array and also improves the signal quality. Prior art circuits for feeding arrays stacks of slot antennas have used a single line with multiple taps. Feeding the slot antennas in the stack using equal length transmission lines increases the cost of feeding the slot antennas but it has been found that this arrangement enables the stack of slot antennas to be used across a large bandwidth as is desired.

Figure 7A:
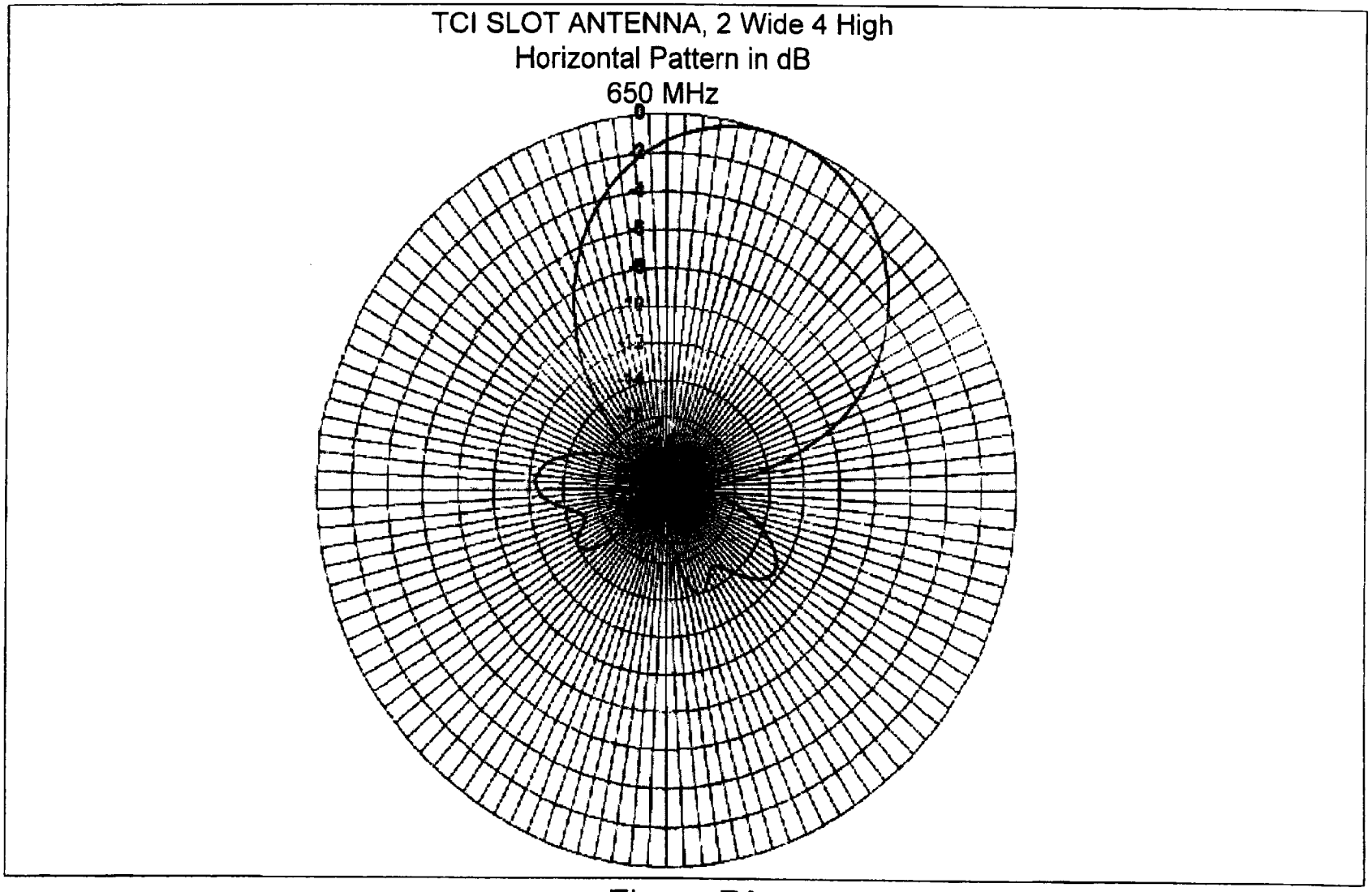
FIG. 7A is an antenna pattern illustrating a signal transmitted by an array of slot antennas that includes two stacks separated by 45 degrees.
Figure 7B:
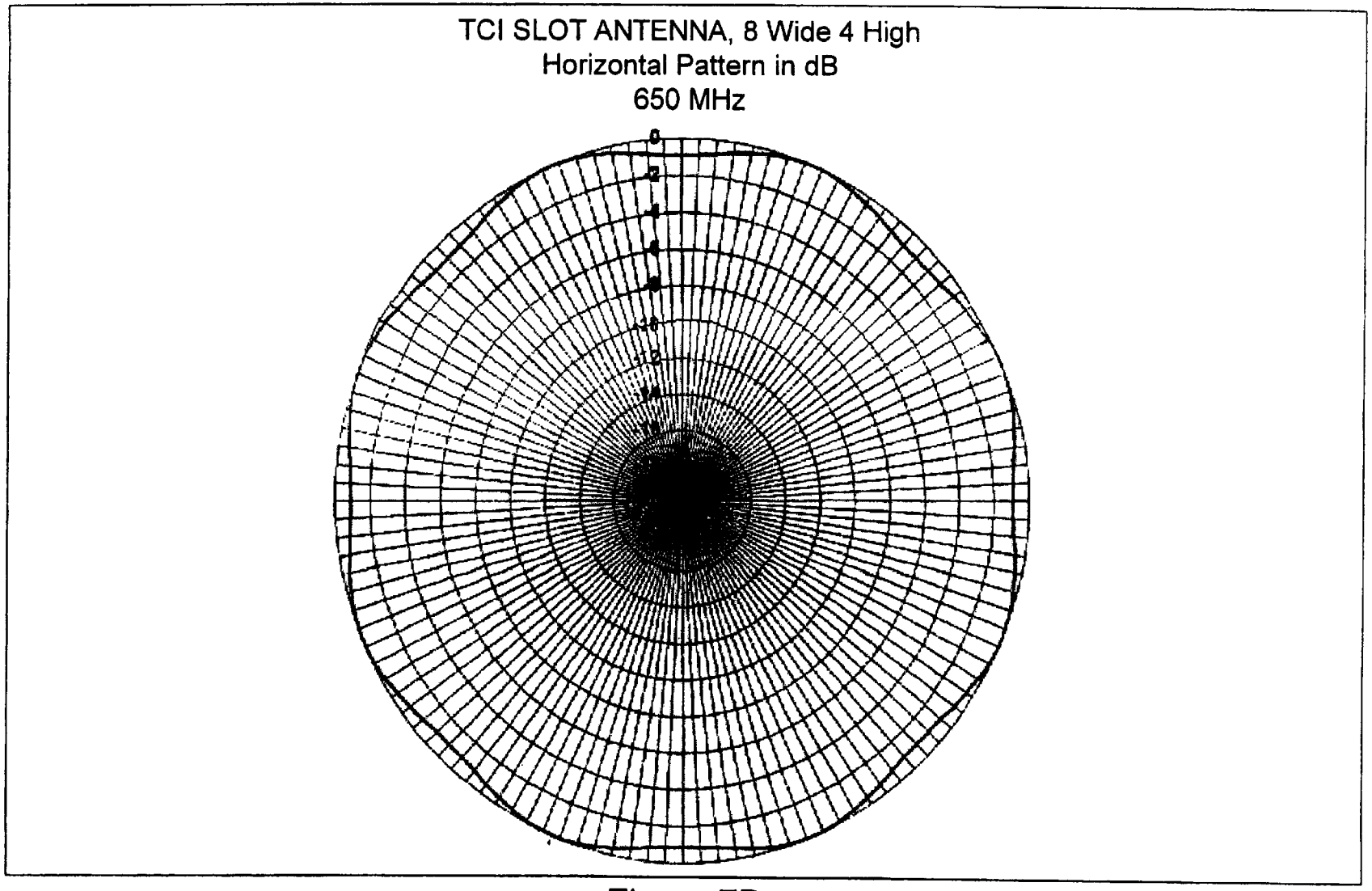
FIG. 7B is an antenna pattern illustrating a signal from eight slot antennas evenly spaced circumferentially around a circle. The pattern is substantially omniazimuthal.

FIG. 7A is an antenna pattern illustrating a signal transmitted by an array of slot antennas that includes two stacks separated by 45 degrees. The pattern is directional away from the slots and substantially uniform within a 50 degree path. FIG. 7B is an antenna pattern illustrating a signal from eight slot antennas evenly spaced circumferentially around a circle. The pattern is substantially omniazimuthal.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. A slot antenna comprising:

a waveguide comprising an open end and a cavity accessible through said open end; and a feeding element positioned in the cavity, the feeding element comprising a member shaped as a stepped cylinder having a first diameter in a central portion along the length of the member and having a second diameter in an outer portion along the length of the member.

2. The slot antenna of claim 1 wherein the feeding element is a T-bar.

3. The slot antenna of claim 1 wherein the opposite ends of the member are terminated at opposite sides of the cavity.

4. The slot antenna of claim 1 further including a ground screen attached to the open end of the waveguide and extending away from the waveguide substantially in the plane of the open end.

5. The slot antenna of claim 1 further including a conductive ridge attached inside the cavity approximately at the edge of the open end.

6. The slot antenna of claim 1 wherein the waveguide further comprises a feeding point for providing a signal to the feeding element.

7. The slot antenna of claim 6 wherein the cavity has a depth defined by the distance between the open end and the surface opposite the open end and the feeding point is located a distance corresponding to about two thirds of the depth from the open end.

8. The slot antenna of claim 1 further including a dielectric radome covering the open end.

9. A slot antenna array comprising:

a plurality of slot antennas, each slot antenna comprising:

a waveguide comprising an open end and a cavity accessible through said open end; and a feeding element positioned in the cavity, the feeding element comprising a member shaped as a stepped cylinder having a first diameter in a central portion along the length of the member and having a second diameter in an outer portion along the length of the member;

wherein the plurality of slot antennas are arrayed about the circumference of a circle in a circular array with the open ends of the slot antennas facing radially outward.

10. The slot antenna array of claim 9 wherein a first subset of the plurality of slot antennas is arrayed about the circumference of a circle in a first circular array with the open ends of the slot antennas facing radially outward;

a second subset of the plurality of slot antennas is arrayed about the circumference of a circle in a second circular array with the open ends of the slot antennas facing radially outward; and the second circular array is stacked on top of the first circular array to form a cylindrical array with the open ends of the slot antennas facing radially outward.

* * * * *